US010600382B2

(12) United States Patent
Zheng et al.

(10) Patent No.: US 10,600,382 B2
(45) Date of Patent: Mar. 24, 2020

(54) ARRAY SUBSTRATE, DATA DRIVING CIRCUIT, DATA DRIVING METHOD AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Yi Zheng, Beijing (CN); Jun Long, Beijing (CN); Lei Guo, Beijing (CN); Lingyun Shi, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 325 days.

(21) Appl. No.: 15/227,340

(22) Filed: Aug. 3, 2016

(65) Prior Publication Data

US 2017/0236484 A1 Aug. 17, 2017

(30) Foreign Application Priority Data

Feb. 17, 2016 (CN) ..... 2016 1 0089890

(51) Int. Cl.
*G09G 3/36* (2006.01)

(52) U.S. Cl.
CPC ..... *G09G 3/3688* (2013.01); *G09G 3/3655* (2013.01); *G09G 3/3659* (2013.01);
(Continued)

(58) Field of Classification Search
CPC ..... G09G 3/3655; G09G 3/3677; G09G 2300/0876; G09G 2310/0202;
(Continued)

(56) References Cited

U.S. PATENT DOCUMENTS

2001/0046027 A1* 11/2001 Tai ..... G02F 1/134363 349/159
2003/0090448 A1 5/2003 Tsumura et al.
(Continued)

FOREIGN PATENT DOCUMENTS

CN 101551561 A 10/2009
CN 101726893 A 6/2010
(Continued)

OTHER PUBLICATIONS

The First Chinese Office Action dated Apr. 11, 2018; Appln. No. 201610089890.7.

*Primary Examiner* — Amare Mengistu
*Assistant Examiner* — Jennifer L Zubajlo
(74) *Attorney, Agent, or Firm* — Ladas & Parry LLP; Hermine Valizadeh

(57) ABSTRACT

An array substrate, data driving circuit, data driving method and display apparatus are provided. The array substrate comprises multiple rows of first scan lines, multiple rows of second scan lines, and multiple columns of data lines. The first scan lines and the data lines define crosswise pixel regions in which pixel electrodes, common electrodes, first switch unit and second switch unit are disposed. The pixel electrode is connected to data line adjacent in first row direction through first and second terminals of first switch unit. The common electrode is connected to data line adjacent in second row direction through first and second terminals of second switch unit. The first and second scan lines are connected to control terminals of first and second switch unit within odd-numbered and even-numbered column pixel regions respectively. The amount of the data lines and the number of pins of data driving chip can be reduced.

20 Claims, 4 Drawing Sheets

(52) U.S. Cl.
CPC ..... *G09G 3/3677* (2013.01); *G09G 3/3696* (2013.01); *G09G 2300/0876* (2013.01); *G09G 2310/0202* (2013.01); *G09G 2310/08* (2013.01); *G09G 2320/0219* (2013.01)

(58) Field of Classification Search
CPC ..... G09G 2310/08; G09G 2320/0219; G09G 3/3688; G09G 3/3696; G09G 3/3659
See application file for complete search history.

(56) References Cited

U.S. PATENT DOCUMENTS

| | | | | |
|---|---|---|---|---|
| 2009/0135117 | A1* | 5/2009 | Cho | G02F 1/134363 345/87 |
| 2009/0251398 | A1* | 10/2009 | Lee | G02F 1/13624 345/87 |
| 2010/0103085 | A1 | 4/2010 | Lee et al. | |
| 2014/0111723 | A1* | 4/2014 | He | G02F 1/13452 349/43 |
| 2016/0048068 | A1 | 2/2016 | Kim et al. | |
| 2016/0351151 | A1 | 12/2016 | Cao | |

FOREIGN PATENT DOCUMENTS

| | | | |
|---|---|---|---|
| CN | 101900915 | A | 12/2010 |
| CN | 104808407 | A | 7/2015 |
| WO | 2005/059637 | A1 | 6/2005 |

* cited by examiner

ARRAY SUBSTRATE, DATA DRIVING CIRCUIT, DATA DRIVING METHOD AND DISPLAY APPARATUS

TECHNICAL FIELD

The present disclosure relates to an array substrate, a data driving circuit, a data driving method and a display apparatus.

BACKGROUND

At present, in a liquid crystal display (LCD), liquid crystal molecules in a liquid crystal layer deflect usually under the control of an electric field formed between a pixel electrode and a common electrode, to form a liquid crystal display. In particular, pixel electrodes within each pixel are charged through coordination of a transistor, a scan line and a data line so as to reach a given gray scale voltage, while the common electrode functions as a voltage common terminal to load a uniform common voltage. However, due to manufacturing process and so on, difference may exist in actual charging effects between different pixel electrodes, thereby resulting in poor display such as flicker or luminance mura. In this regard, although difference in the charging effects between different pixel electrodes can be compensated theoretically by adjusting a voltage of another terminal of the liquid crystal capacitor, i.e., the voltage of the common electrode, the common electrode taken as a voltage common terminal would simultaneously influence displaying of a plurality of pixels, and the loaded voltage cannot be adjusted for each pixel.

SUMMARY

There are provided in some embodiments of the present disclosure an array substrate, a data driving circuit, a data driving method and a display apparatus, which can implement adjusting voltage of a common electrode of a single pixel.

According to a first aspect of the present disclosure, there is provided an array substrate, comprising multiple rows of first scan lines and multiple columns of data lines, the multiple rows of first scan lines and the multiple columns of data lines defining crosswise several pixel regions in which a pixel electrode, a common electrode, a first switch unit and a second switch unit are disposed;

a pixel electrode within any pixel region being connected to a data line adjacent in a first row direction through a first terminal and a second terminal of the first switch unit; a common electrode within any pixel region is connected to a data line adjacent in a second row direction through a first terminal and a second terminal of the second switch unit; and the first row direction being opposite to the second row direction; and corresponding to the pixel regions of any row, one row of second scan lines being disposed except for one row of first scan lines; wherein the first scan lines are connected to control terminals of a first switch unit and a second switch unit within pixel regions of odd-numbered columns; the second scan lines are connected to control terminals of a first switch unit and a second switch unit within pixel regions of even-numbered columns.

Optionally, in a row direction, a strip-shaped pixel electrode and a strip-shaped common electrode are arranged alternately.

Optically, within any pixel region, the pixel electrode and the common electrode are at least partially overlapped.

Optically, within any pixel region, the strip-shaped pixel electrode is located on a side of a plate-shaped common electrode that is opposite to a substrate.

Optically, within any pixel region, the strip-shaped common electrode is located on a side of a plate-shaped pixel electrode that is opposite to the substrate.

Optionally, the array substrate further comprises a scan driving circuit connected to all the first scan lines and all the second scan lines; the scan driving circuit is used to output a pulse signal with an active level to a first scan line and a second scan line corresponding to the pixel regions of each row in sequence; and corresponding to the pixel regions of any row, a pulse signal on the first scan line and a pulse signal on the second scan line are staggered to each other in time.

Optionally, the first switch unit and/or the second switch unit comprises a thin film transistor, wherein a gate of the thin film transistor is connected to a control terminal, and a source and a drain thereof are connected to one of a first terminal and a second terminal, respectively.

According to a second aspect of the present disclosure, there is further provided a data driving circuit used for any array substrate described above, comprising:

a first output unit configured to, during a level of a first scan line corresponding to pixel regions of any row being an active level, output a data voltage signal to a data line that is adjacent to, in a first row direction pixel regions of an odd-numbered columns in the row, and output a common voltage signal to a data line that is adjacent to, in a second row direction, pixel regions of odd-numbered columns in the row; and a second output unit configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

According to a third aspect, there is further provided a data driving method used for any one of the array substrates described above, comprising:

during a level of a first scan line corresponding to pixel regions of any row being an active level, outputting a data voltage signal to a data line that is adjacent to, in a first row direction, pixel regions of odd-numbered columns in the row, and outputting a common voltage signal to a data line that is adjacent to, in a second row direction, pixel regions of odd-numbered columns in the row; and during a level of a second scan line corresponding to the pixel regions of any row being an active level, outputting a data voltage signal to a data line that is adjacent to, in the first row direction, pixel regions of even-numbered columns in the row, and outputting a common voltage signal to a data line that is adjacent to, in the second row direction, pixel regions of even-numbered columns in the row.

According to a fourth aspect, there is further provided a display apparatus, comprising any one of the array substrates described above.

It can be known from the above technical solution that, in the array substrate provided in the present disclosure, the common electrode within each pixel can receive the voltage from the data line when the second switch unit connects the first terminal with the second terminal, and the change of this voltage would only make an effect on the pixel region where the voltage is in, but would not affect other pixel regions. Thus, the present disclosure can realize adjusting the voltage of the common electrode of a single pixel. Furthermore, the present disclosure can multiplex the data lines in a time-division manner, so as to realize writing the data voltage of each pixel electrode and writing the common voltage of each common electrode, so that the amount of usage of data lines could be reduced effectively, the structure of the array substrate could be simplified, the number of pins of a data driving chip could be reduced, and product cost could be reduced.

Of course, any product or method that implements the present disclosure is not necessary to achieve all the benefits described above.

DETAILED DESCRIPTION

In order to make technical solutions and advantages of the present disclosure more clear, embodiments of the present disclosure will be described clearly and completely by combining with the figures. Obviously, the embodiments described below are just a part of embodiments of the present disclosure, but not all the embodiments.

Figure 1:
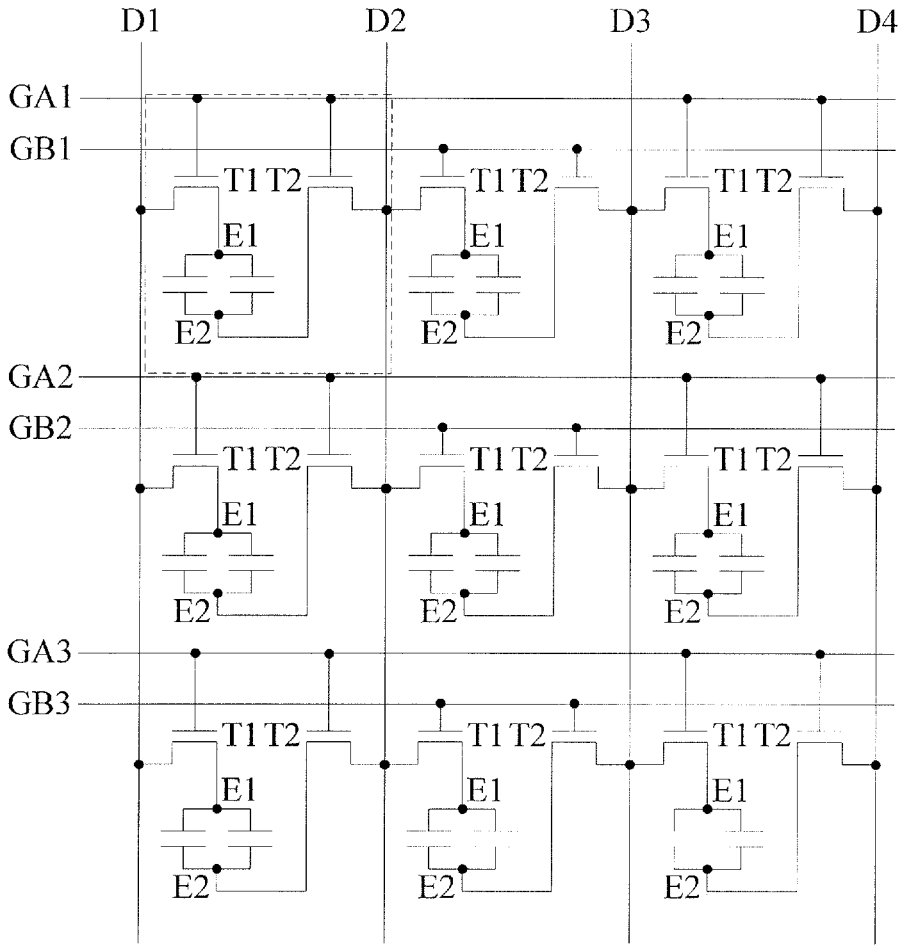
FIG. 1 is a schematic diagram of a circuit structure of an array substrate in an embodiment of the present disclosure.

FIG. 1 is a schematic diagram of a circuit structure of an array substrate in an embodiment of the present disclosure. As shown in FIG. 1, three rows of first scan lines GA1, GA2, and GA3 represent multiple rows of first scan lines in the array substrate, three rows of second scan lines GB1, GB2, and GB3 represent multiple rows of second scan lines in the array substrate, and three columns of data lines D1, D2, and D3 represent multiple columns of data lines in the array substrate (besides the three columns of data lines D1, D2, and D3, FIG. 1 also shows a fourth column of data lines D4 as an example). A dashed block in FIG. 1 represents one pixel region. That is, several pixel regions on the array substrate are defined crosswise by the multiple rows of first scan lines and the multiple columns of data lines. It may be understood that the exact number of pixel regions, first scan lines, second scan lines and data lines can be determined depending on the specific requirement for displaying, to which the embodiments of the present disclosure do not limit.

Within the pixel region, a pixel electrode E1, a common electrode E2, a first switch unit T1 and a second switch unit T3 are set. Herein, the pixel electrode E1 is an electrode within the pixel region that is used to load a data voltage, while the common electrode E2 is an electrode within the pixel region that is used to load a common voltage. In two capacitors connected between the pixel electrode E1 and the common electrode E2 as shown in FIG. 1, one is a storage capacitor produced under overlapping of the pixel electrode E1 and the common electrode E2, and the other is a liquid crystal capacitor formed equivalently by liquid crystal materials which are located in electric fields formed between the pixel electrode E1 loaded with the data voltage and the common electrode E2 loaded with the common voltage. Thus, the array substrate can be used to realize liquid crystal displaying in a mode of in-plane switching (IPS). It may be understood that there is arranged in the embodiments of the present disclosure the common electrode E2 within each pixel region respectively, that is, making the common electrode E2 maintain insulated electrically among different pixel regions. In order to write the data voltage and the common voltage into each pixel region, in an embodiment of the present disclosure, the array substrate has an internal connection relationship of circuit described below.

As shown in FIG. 1, the pixel electrode E1 within any pixel region is connected to a data line adjacent to a first row direction (i.e., left direction in the figure) through a first terminal and a second terminal (i.e., right terminal and left terminal in the figure) of the first switch unit T1; the common electrode E2 within any pixel region is connected to a data line adjacent to a second row direction (right direction in the figure) through a first terminal and a second terminal (left terminal and right terminal in the figure) of the second switch unit T2; herein, the first row direction is opposite to the second row direction. Thus, for any data line sandwiched between the pixel regions of two columns, it is connected to the common electrode E2 within the pixel region adjacent to the first row direction through the second switch unit T2, and is connected to the pixel electrode E1 within the pixel region adjacent to the second row direction through the first switch unit T1. That is, this data line can provide the common voltage for pixel regions on one side, or provide the data voltage for pixel regions on another side.

As shown in FIG. 1, corresponding to the pixel regions of any row, one row of second scan lines is further disposed except for one row of first scan lines. Herein, the first scan lines are connected to control terminals of the first switch unit and the second switch unit within pixel regions of odd-numbered columns (for example, in FIG. 1, control terminals of a first switch unit and a second switch unit within pixel regions of a first column and a third column are connected to the first scan lines); the second scan lines are connected to control terminals of a first switch unit and a second switch unit within pixel regions of even-numbered columns (for example, in FIG. 1, control terminals of a first switch unit and a second switch unit within pixel regions of a second column are connected to the second scan lines).

As shown in FIG. 1, the first switch unit T1 and the second switch unit T2 in the embodiments of the present disclosure comprise a thin film transistor, respectively. A gate of the thin film transistor is connected to a control terminal of a switch unit, and a source and a drain thereof are connected to one of a first terminal and a second terminal of the switch unit, respectively. Thus, by utilizing difference of volt-ampere characteristics of the thin film transistor in a saturated area (or a linear area) and a cutoff area, a current between the first terminal and the second terminal can be formed when an active level is received at the control terminal, and the current between the first terminal and the second terminal is cut off when an inactive level is received. Of course, other devices or circuit structures can also be adopted to form the above switch unit, so that the switch unit can connect the first terminal with the second terminal when the active level is received by the control terminal, and disconnect the first terminal from the second terminal when the inactive level is received by the control terminal, to which the present disclosure does not limit.

It needs to note that the active level and the inactive level refer to two level ranges which are not crossed to each other, for example, 8~15V and 0~7V. In a specific application scenario, the level range of the active level and the inactive level can be set specifically according to parameters such as circuit characteristic of the switch unit, resistance of the scan line and output characteristic of circuit connected to the scan line or the like, to which the present disclosure does not limit. Furthermore, for the convenience of description, all the thin film transistors in the text take N-type thin film transistors as an example. In actual application scenario, each N-type thin film transistor can be replaced with a P-type thin film transistor, which depends on the level range set by the active level and the inactive level, and thus those skilled in the art can adjust flexibly according to the requirement. In addition, the source and the drain can be deemed as two electrodes without being specially distinguished when the thin film transistor has a structure where the source and the drain are symmetrical. Herein, no further description is given.

Based on the connection relationship among the first scan line, the second scan line, the first switch unit, and the second switch unit, when any row of first scan lines output the active level, a first switch unit and a second switch unit within pixel regions of odd-numbered columns can connect the first terminal with the second terminal, so that the odd-numbered columns of data lines can input the data voltage to the pixel electrodes, and the even-numbered columns of data lines can input the common voltage to the common electrodes; when any row of second scan lines output the active level, a first switch unit and a second switch unit within pixel regions of even-numbered columns can connect the first terminal with the second terminal, so that the even-numbered columns of data lines can input the data voltage to the pixel electrodes, and the odd-numbered columns of data lines can input the common voltage to the common electrodes.

Thus, liquid crystal capacitors within pixel regions of the odd-numbered columns and the even-numbered columns can be charged respectively only if the first scan lines and the second scan lines corresponding to the pixel regions of each row are staggered to each other in a period of time when the active level is output within each display frame, so as to realize writing of the data voltage and the common voltage of each liquid crystal capacitor through coordination of signal timings of the first scan line, the second scan line and data line.

On one hand, compared with the technical solution of removing the second switch unit and the second scan line and making all the common electrodes connected to an input terminal of one common voltage, the embodiments of the present disclosure can realize controlling separately the common voltage within each pixel region, i.e., realizing adjustment of a voltage of a common electrode of a single pixel. For the scenario of producing display gray scale difference between different pixels caused by luminance mura, crosstalk and so on, the embodiments of the present disclosure can perform corresponding compensation by individually adjusting the common voltage of each pixel, so as to raise the display effect. Furthermore, since adjusting the common voltage can be realized by adjusting the data voltage signal, the mode of adjusting the common voltage can be changed flexibly, with strong generality.

On the other hand, compared with the technical solution of removing the second scan line and making each switch unit connected to one data line respectively, the embodiments of the present disclosure can multiplex the data line in a time-division manner, so that the amount of usage of the data lines and the number of pins of the data driving chip can be reduced effectively, which is helpful to reduce the product cost.

It shall be understood that although a storage capacitor formed by at least partially overlapping of the pixel electrode and the common electrode is disposed within each pixel region in the embodiments of the present disclosure, the storage capacitor can be formed in other manners (for example, disposing that the auxiliary electrode connected to the common terminal voltage is overlapped with the pixel electrode), and may be not disposed in a specific application scenario, which does not influence that the technical solution can realize adjusting of the voltage of the common electrode of the single pixel, to which the present disclosure does not limit.

It shall be further understood that, when the scan driving circuit is disposed within the array substrate in a manner of gate driver on array (GOA) according to the embodiments of the present disclosure, the scan driving circuit can be connected to all the first scan lines and all the second scan lines, and is used to output the pulse signals with the active level to a first scan line and a second scan line corresponding to the pixel regions of each row in sequence. Corresponding to the pixel regions of ally row, the pulse signal of the first scan line and the pulse signal of the second scan line are staggered to each other in time. On such a basis, adjusting the voltage of the common electrode of the single pixel can be realized according to the mode that the pixel regions of the odd-numbered columns and the even-numbered columns charge the liquid crystal capacitor separately in time. Of course, in the specific application, a circuit structure having similar functions can also be adopted to provide the signals which are staggered to each other in the time of the active level, for the first scan line and the second scan line, outside the array substrate, to which the present disclosure does not limit.

Figure 2:
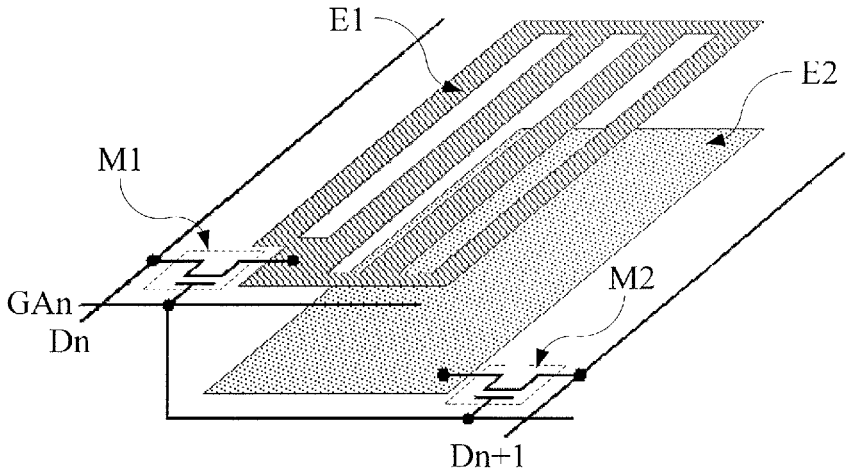
FIG. 2 is a schematic diagram of an internal structure of a pixel region in an array substrate in an embodiment of the present disclosure.

In addition, as an example of setting the pixel electrodes and the common electrodes within the pixel regions, FIG. 2 is a schematic diagram of an internal structure of pixel regions in an array substrate in an embodiment of the present disclosure. As shown in FIG. 2, a strip-shaped pixel electrode E1 is located on a side of a plate-shaped common electrode E2 that is opposite to a substrate (that is, the plate-shape structure of the array substrate that is opposite to a side of the liquid crystal layer is taken as a basis of manufacturing other structures of the array substrate). At the same time, the pixel electrode E1 is connected to the data line Dn adjacent to the first row direction through the source and drain of the thin film transistor M1, while the common electrode E2 is connected to the data line Dn+1 adjacent to the second row direction through the source and drain of the thin film transistor M2; the first scan line GAn (it may also be the second scan line, and it is just taken as an example) is connected to the gate of the thin film transistor M1 and the gate of the thin film transistor M2 respectively. It could be understood that in thickness direction of the array substrate, the pixel electrode E1 and the common electrode E2 are located at different layers, and thus they can be overlapped with each other to form the above storage capacitor, and produce an electric field in a horizontal direction in the upper of the figure under the coordination of the strip pattern and the plate pattern. Thus, the array substrate in the embodiments of the present disclosure can be used to form a liquid crystal displaying for example in an advanced super dimension switch (ADS) mode. It shall be understood that positions and wiring modes of the data lines and the first scan lines in the figure are just for illustration, and can be specially disposed in a specific application scenario under the premise that a necessary connection relationship is realized, to which the present disclosure does not limit.

It could be understood that, on the basis of FIG. 2, setting up the common electrode as an upper strip-shaped electrode while setting up the pixel electrode as a lower plate-shaped electrode (that is, within any pixel region, the strip-shaped common electrode is located on the side of the plate-shaped pixel electrode that is opposite to the substrate) can be also applied to form a liquid crystal display for example in the ADS mode when the above circuit connection relationship is maintained, to which the present disclosure does not limit. In addition, it may be further disposed that the strip-shaped pixel electrode and the strip-shaped common electrode in the row direction are arranged alternatively, so as to be used to form a liquid crystal display for example in a fringe field switching (FFS) mode.

Figure 3:
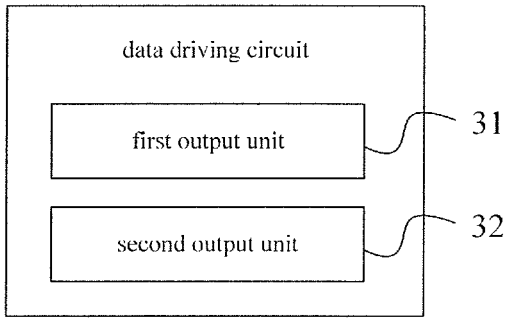
FIG. 3 is a block diagram of a structure of a data driving circuit used for any one of the array substrates in an embodiment of the present disclosure.

Based on the same inventive concept, FIG. 3 is a block diagram of a structure of a data driving circuit used for any one of the array substrates in an embodiment of the present disclosure. As shown in FIG. 3, the data driving circuit comprises:

a first output unit 31 configured to, during a level of a first scan line corresponding to pixel regions of any row being an active level, output a data voltage signal to a data line that is adjacent to, in a first row direction, pixel regions of odd-numbered columns in the row, and output a common voltage signal to a data line that is adjacent to, in a second row direction, pixel regions of odd-numbered columns in the row; and a second output unit 32 configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

It could be understood that the data driving circuit in the embodiments of the present disclosure can be used to provide input of voltage signals for multiple columns of data lines of any array substrate described above, so that the array substrate can realize controlling separately the common voltage within each pixel region. For the scenario of producing differences of display gray scales between different pixels caused by luminance mura, crosstalk and so on, the embodiments of the present disclosure can perform corresponding compensation by individually adjusting the common voltage of each pixel, so as to raise the display effect. Furthermore, since adjusting the common voltage can be realized by adjusting the data voltage signal, the mode of adjusting the common voltage can be changed flexibly, with strong generality. In another aspect, the embodiments of the present disclosure can multiplex the data lines in a time-division manner, so that the amount of usage of the data lines and the number of pins of the data driving chip can be reduced effectively, which is helpful to reduce the product cost.

Figure 4:
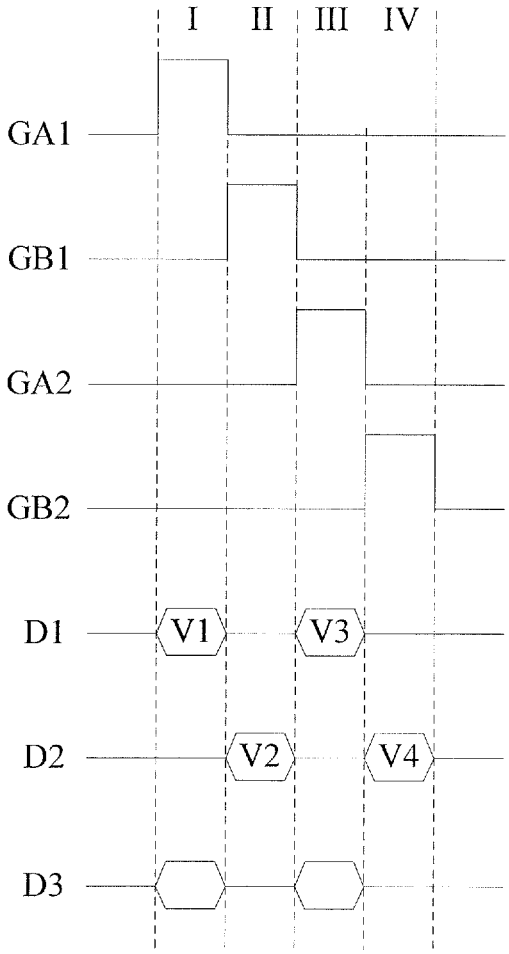
FIG. 4 is a circuit timing diagram corresponding to the circuit structure as shown in FIG. 1.

As a specific example, FIG. 4 shows a timing diagram of circuit corresponding to the circuit structure as shown in FIG. 1. By referring to FIGS. 1 and 4, the operation principles of the circuit can be described as follows:

For the first scan line GA1, its active level occurs in a first phase I. At this time, the first output unit 31 outputs a data voltage signal V1 to the odd-numbered columns of data lines (including the data line D1), and outputs a common voltage signal (taking a zero level as an example in the present embodiment) to the even-numbered columns of data lines (including the data line D2). Thus, within the pixel region as shown in the dashed block, the pixel electrode can receive the data voltage signal V1 from the data line D1, and the common electrode can receive the common voltage signal from the data line D2.

For the second scan line GB1, its active level occurs in a second phase II. At this time, the second output unit 32 outputs a data voltage signal V2 to the even-numbered columns of data lines (including the data line D2), and outputs a common voltage signal (taking a zero level as an example) to the odd-numbered columns of data lines (including the data line D3). Thus, within the pixel region of the second column in the first row, the pixel electrode can receive the data voltage signal V2 from the data line D2, and the common electrode can receive the common voltage signal from the data line D3.

For the first scan line GA2, its active level occurs in a third phase III. At this time, the first output unit 31 outputs a data voltage signal V3 to the odd-numbered columns of data lines (including the data line D1), and outputs a common voltage signal (taking a zero level as an example) to the even-numbered columns of data lines (including the data line D2). Thus, within the pixel region of the first column in the second row, the pixel electrode can receive the data voltage signal V3 from the data line D1, and the common electrode can receive the common voltage signal from the data line D2.

For the second scan line GB2, its active level occurs in a fourth phase IV. At this time, the second output unit 32 outputs a data voltage signal V4 to the even-numbered columns of data lines (including the data line D2), and outputs a common voltage signal (taking a zero level as an example) to the odd-numbered columns of data lines (including the data line D3). Thus, within the pixel region of the second column in the first row, the pixel electrode can receive the data voltage signal V4 from the data line D2 and the common electrode can receive the common voltage signal from the data line D3.

It can be seen that since the active levels of the first scan lines and the second scan lines are separate in time, the data voltage and the common voltage can be written into each pair of the pixel regions of the odd-numbered columns and the pixel regions of the even-numbered column sequentially. On such a basis, the data voltage and the common voltage can be written into all the pixel regions within one display frame respectively, and the number of the data lines and the number of the output terminals of the data driving circuit are almost consistent with the number of columns of the pixel regions (there is a difference of 1 in the number).

Figure 5:
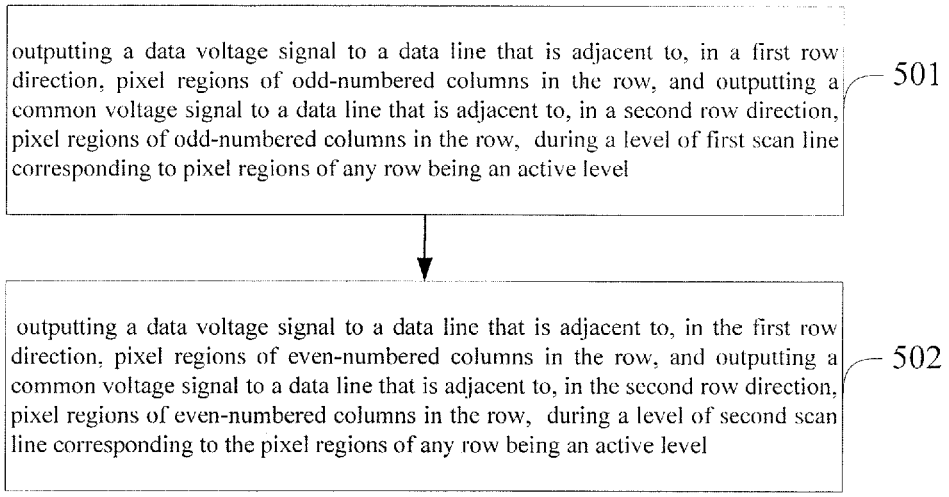
FIG. 5 is a flow diagram of a data driving method used for an array substrate in an embodiment of the present disclosure.

Based on the same inventive concept, FIG. 5 is flow diagram of a data driving method used for any one of the array substrates described in embodiments of the present disclosure. As shown in FIG. 5, the data driving method comprises following operation processes:

In step 501: during a level on a first scan lines corresponding to pixel regions of any row being an active level, outputting a data voltage signal to a data line that is adjacent to, in a first row direction, pixel regions of odd-numbered columns in the row, and outputting a common voltage signal to a data line that is adjacent to, in a second row direction, pixel regions of odd-numbered columns in the row; and In step 502: during a level on a second scan line corresponding to the pixel regions of any row being an active level, outputting a data voltage signal to a data line that is adjacent to, in the first row direction, pixel regions of even-numbered columns in the row, and outputting a common voltage signal to a data line that is adjacent to, in the second row direction, pixel regions of even-numbered columns in the row.

It could be understood that the data driving circuit in the embodiments of the present disclosure can be used to provide input of voltage signals for multiple columns of data lines of any array substrate described above, so that the array substrate can realize controlling separately the common voltage within each pixel region. For the scenario of producing differences of display gray scales between different pixels caused by luminance mura, crosstalk and so on, the embodiments of the present disclosure can perform corresponding compensation by individually adjusting the common voltage of each pixel, so as to raise the display effect. Furthermore, since adjusting the common voltage can be realized by adjusting the data voltage signal, the mode of adjusting the common voltage can be changed flexibly, with strong generality. In another aspect, the embodiments of the present disclosure can multiplex the data lines in a time-division manner, so that the amount of usage of the data lines and the number of pins of the data driving chip can be reduced effectively, which is helpful to reduce the product cost.

It could be further understood that the operation process in step 501 is corresponding to the function of the first output unit 31, while the operation process in step 502 is corresponding to the function of the second output unit 32. Therefore, the embodiment of the present disclosure can have a specific implementation mode corresponding to the above data driving circuit. Herein, no further description is given.

Based on a same inventive concept, there is provided in an embodiment of the present disclosure a display apparatus, comprising any one of the array substrate described above. It needs to note that the display apparatus in the present embodiment can be any product or components having a display function such as a liquid crystal display panel, an electronic paper, a mobile phone, a table computer, a television set, a notebook computer, a digital photo frame, and a navigator or the like. It can be understood that since the display apparatus in the embodiment of the present disclosure comprises any one of the array substrates described above, it can also controlling separately the common voltage within each pixel region, so as to raise the display effect and has strong generality. The embodiment of the present disclosure can multiplex the data lines in a time-division manner, so that the amount of usage of the data lines and the number of pins of the data driving chip can be reduced effectively, which is helpful to reduce the product cost.

It needs to note that in the text, relationship terms such as first and second are just used to distinguish one entity or operation from another entity or operation, but does not necessarily require or suggest that any such actual relationship or sequence exists among these entities or operations. Furthermore, terms of "including", "comprising" or any other variants intend to cover non-exclusive containing, so that a process, method, object or device containing a series of elements not only comprise those elements, but also comprise other elements not listed explicitly, or further comprise elements inherent to such process, method, object or device. In the case of no further limitation, an element defined by an expression of "comprising one . . . " does not exclude that there exists additional same element in the process, method, objects or device comprising the element. Orientation or position relationship indicated by terms "upper" and "lower" is the orientation or position relationship as shown in the figure, and it is just used to describe the embodiments of the present disclosure and simplify the description, but not used to indicate or suggest that the apparatus or element referred to must have a specific orientation and must be constructed and operated in a unique direction, and thus it could not be understood as a limitation to the present disclosure. Unless otherwise specified and limited, terms of "install", "connect to" and "connect with" shall be understood broadly, for example, it may be a fixed connection, or may be a removable connection or a unified connection; it may be a mechanical connection, or may be an electrical connection; it may be a direct connection, or may be an indirect connection via an intermediate media, or may be an internal connection of two elements. For those ordinary skilled in the art, the specific meanings of the above terms in the present disclosure can be understood according to the specific situation.

In the description of the present disclosure, a large amount of specific details are described. However, it can be understood that the embodiments of the present disclosure can be implemented without these specific details. In some embodiments, the common method, structure and technique are not shown in detail, so as to clarify the understanding of the description. Similarly, it shall be understood that in order to simplify the present disclosure and help to understand one or more of the respective invention aspects, in the description of exemplary embodiments of the present disclosure, the respective features of the present disclosure are sometimes grouped into a single embodiment, figure or its description.

Finally, it should be noted that the above embodiments are just used to describe the technical solutions of the present disclosure but not used for limiting. Although the present disclosure is described in detail As shown in the previous embodiments, those ordinary skilled in the art shall understand that they can modify the technical solutions disclosed in the embodiments or replace a part or all of the technical features. These amendments or replacements do not make the substance of the corresponding technical solutions depart from the scope of the technical solutions of the embodiments of the present disclosure, and shall be covered within the scope of the Claims and specification of the present disclosure.

The present application claims the priority of a Chinese patent application No. 201610089890.7 filed on Feb. 17, 2016. Herein, the content disclosed by the Chinese patent application is incorporated in full by reference as a part of the present disclosure.

What is claimed is:

1. An array substrate, comprising multiple rows of first scan lines and multiple columns of data lines, the multiple rows of first scan lines and the multiple columns of data lines defining crosswise several pixel regions in which a pixel electrode, a common electrode, a first switch unit and a second switch unit are disposed;

a pixel electrode within any pixel region being connected to a data line adjacent in a first row direction through a first terminal and a second terminal of the first switch unit;

a common electrode within any pixel region being connected to a data line adjacent in a second row direction through a first terminal and a second terminal of the second switch unit, and the first row direction being opposite to the second row direction; and corresponding to the pixel regions of any row, one row of second scan lines being disposed except for one row of first scan lines, wherein the first scan lines are connected to control terminals of a first switch unit and a second switch unit within pixel regions of odd-numbered columns; and the second scan lines are connected to control terminals of a first switch unit and a second switch unit within pixel regions of even-numbered columns;

wherein at least one of the pixel electrode and the common electrode is a plate shaped electrode with a plurality of stripe-shaped cutouts, and a length of each of the plurality of stripe-shaped cutouts in a first direction is shorter than a length of the plate shaped electrode in the first direction, and a boundary line of each of the plurality of stripe-shaped cutouts does not overlap a boundary of the plate shaped electrode.

2. The array substrate according to claim 1, wherein a strip-shaped pixel electrode and a strip-shaped common electrode are arranged alternately in a row direction.

3. A data driving circuit used for the array substrate according to claim 2, comprising:

a first output sub-circuit configured to, during a level of a first scan line corresponding to pixel regions of any row being an active level, output a data voltage signal to a data line that is adjacent to, in a first row direction pixel regions of odd-numbered columns in the row, and output a common voltage signal to a data line that is adjacent to, in a second row direction pixel regions of odd-numbered columns in the row; and a second output sub-circuit configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

4. The array substrate according to claim 1, wherein the pixel electrode and the common electrode are at least partially overlapped within any pixel region.

5. A data driving circuit used for the array substrate according to claim 4, comprising:

a first output sub-circuit configured to, during a level of a first scan line corresponding to pixel regions of any row being an active level, output a data voltage signal to a data line that is adjacent to, in a first row direction, pixel regions of odd-numbered columns in the row, and output a common voltage signal to a data line that is adjacent to, in a second row direction, pixel regions of odd-numbered columns in the row; and a second output sub-circuit configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

6. The array substrate according to claim 1, wherein a strip-shaped pixel electrode is located on a side of a plate-shaped common electrode that is opposite to a substrate within any pixel region.

7. A data driving circuit used for the array substrate according to claim 6, comprising:

a first output sub-circuit configured to, during a level of a first scan line corresponding to pixel regions of any row being an active level, output a data voltage signal to a data line that is adjacent to, in a first row direction, pixel regions of odd-numbered columns in the row, and output a common voltage signal to a data line that is adjacent to, in a second row direction, pixel regions of odd-numbered columns in the row; and a second output sub-circuit configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

8. The array substrate according to claim 1, wherein a strip-shaped common electrode is located on a side of a plate-shaped pixel electrode that is opposite to the substrate within any pixel region.

9. A data driving circuit used for the array substrate according to claim 8, comprising:

a first output sub-circuit configured to, during a level of a first scan line corresponding to pixel regions of any row being an active level, output a data voltage signal to a data line that is adjacent to, in a first row direction, pixel regions of odd-numbered columns in the row, and output a common voltage signal to a data line that is adjacent to, in a second row direction, pixel regions of odd-numbered columns in the row; and a second output sub-circuit configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

10. The array substrate according to claim 1, wherein the array substrate further comprises a scan driving circuit connected to all the first scan lines and all the second scan lines; the scan driving circuit is configured to output a pulse signal with an active level to a first scan line and a second scan line corresponding to the pixel regions of each row in sequence; and corresponding to the pixel regions of any row, a pulse signal on the first scan line and a pulse signal on the second scan line are staggered to each other in time.

11. A data driving circuit used for the array substrate according to claim 10, comprising:

a first output sub-circuit configured to, during a level of a first scan line corresponding to pixel regions of any row being an active level, output a data voltage signal to a data line that is adjacent to, in a first row direction, pixel regions of odd-numbered columns in the row, and output a common voltage signal to a data line that is adjacent to, in a second row direction, pixel regions of odd-numbered columns in the row; and a second output sub-circuit configured to, during a level of a second scan line corresponding to the pixel regions of any row being an active level, output a data voltage signal to a data line that is adjacent to, in the first row direction, pixel regions of even-numbered columns in the row, and output a common voltage signal to a data line that is adjacent to, in the second row direction, pixel regions of even-numbered columns in the row.

12. The array substrate according to claim 1, wherein the first switch unit and/or the second switch unit comprises a thin film transistor; wherein a gate of the thin film transistor is connected to a control terminal, and a source and a drain thereof are connected to one of a first terminal and a second terminal, respectively.

13. A data driving circuit used for the array substrate according to claim 1, comprising:

a first output sub-circuit configured to, during a level of a first scan line corresponding to pixel regions of any row being an active level, output a data voltage signal to a data line that is adjacent to, in a first row direction, pixel regions of odd-numbered columns in the row, and output a common voltage signal to a data line that is adjacent to, in a second row direction, pixel regions of odd-numbered columns in the row; and a second output sub-circuit configured to, during a level of a second scan line corresponding to pixel regions of any row being an active level, output a data voltage signal to a data line that is adjacent to, in the first row direction, pixel regions of even-numbered columns in the row and output a common voltage signal to a data line that is adjacent to, in the second row direction, pixel regions of even-numbered columns in the row.

14. A data driving method used for the array substrate according to claim 1, comprising:

outputting a data voltage signal to a data line that is adjacent to, in a first row direction, pixel regions of odd-numbered columns in the row, and outputting a common voltage signal to a data line that is adjacent to, in a second row direction, pixel regions of odd-numbered columns in the row, during a level of a first scan line corresponding to pixel regions of any row being an active level; and outputting a data voltage signal to a data line that is adjacent to, in the first row direction, pixel regions of even-numbered columns in the row, and outputting a common voltage signal to a data line that is adjacent to, in the second row direction, pixel regions of even-numbered columns in the row, during a level of a second scan line corresponding to the pixel region of any row being an active level.

15. A display apparatus, comprising the array substrate according to claim 1.

16. The display apparatus according to claim 10, wherein a strip-shaped pixel electrode and a strip-shaped common electrode are arranged alternately in a row direction.

17. The display apparatus according to claim 10, wherein the pixel electrode and the common electrode are at least partially overlapped within any pixel region.

18. The display apparatus according to claim 10, wherein a strip-shaped pixel electrode is located on a side of a plate-shaped common electrode that is opposite to a substrate within any pixel region.

19. The display apparatus according to claim 10, wherein a strip-shaped common electrode is located on a side of a plate-shaped pixel electrode that is opposite to the substrate within any pixel region.

20. The display apparatus according to claim 10, wherein the array substrate further comprises a scan driving circuit connected to all the first scan lines and all the second scan lines; the scan driving circuit is configured to output a pulse signal with an active level to a first scan line and a second scan line corresponding to the pixel regions of each row in sequence; and corresponding to the pixel regions of any row, a pulse signal on the first scan line and a pulse signal on the second scan line are staggered to each other in time.

* * * * *